US005934583A

United States Patent [19]

Jean

[11] Patent Number: 5,934,583

[45] Date of Patent: Aug. 10, 1999

[54] BEARING BLOCK MOUNTING ARRANGEMENT OF A CONE CRUSHER

[76] Inventor: Cheng-Shu Jean, No. 14,Chung Hsing N. St., Sanchung City, Taipei Hsien, Taiwan

[21] Appl. No.: 09/013,004

[22] Filed: Jan. 26, 1998

[51] Int. Cl.[6] ..... B02C 2/06

[52] U.S. Cl. ..... 241/210; 241/209; 241/213

[58] Field of Search ..... 241/207–216

[56] References Cited

U.S. PATENT DOCUMENTS

| | | | |
|---|---|---|---|
| 799,647 | 9/1905 | Hart | 241/209 |
| 3,345,000 | 10/1967 | Decker et al. | 241/209 |
| 3,666,188 | 5/1972 | Lippmann | 241/213 |

FOREIGN PATENT DOCUMENTS

| | | | |
|---|---|---|---|
| 512606 | 10/1930 | Germany | 241/210 |
| 1164804 | 3/1964 | Germany | 241/209 |

*Primary Examiner*—Mark Rosenbaum
*Attorney, Agent, or Firm*—Rosenberg, Klein & Bilker

[57] ABSTRACT

A bearing block mounting arrangement of a cone crusher in which the bearing block includes an upper block and a bottom block respectively covered on top and bottom sides of a spider bearing around a main shaft, the upper block and the bottom block each having an outward flange and a plurality of locating holes and screw holes alternatively arranged around the spider bearing, the locating holes on the outward flange of the upper block being respectively connected to the locating holes on the outward flange of the bottom block and respective locating holes on a locating block inside the cone crusher by screw bolts and nuts, and a plurality of adjustment screws respectively threaded into the screw holes on the upper block and the bottom block and stopped at top and bottom sides of the locating block for adjusting the gap between the upper block and the bottom block.

3 Claims, 4 Drawing Sheets

BEARING BLOCK MOUNTING ARRANGEMENT OF A CONE CRUSHER

BACKGROUND OF THE INVENTION

In industries, cone crushers are used in crushing big stones into small pieces for use in construction. FIGS. 1 and 2 show a hydraulic cone crusher designed by the present inventor. The hydraulic cone crusher generally comprises a bottom frame 2, a top frame 3, a main shaft 4, and an eccentric 5. A counter shaft 21 is mounted in the bottom frame 2 at one side. The counter shaft 21 has one end mounted with pinion gear 22, and an opposite end extended out of the bottom frame 2 and mounted with a pulley 23 for coupling to a motor. The top frame 3 is fixedly mounted on the bottom frame 2 at the top, having a concave 31 on the inside, a feed hopper 32 and a distributor 33 on the top. The distributor 33 is driven by a motor 1 mounted on a rack 321 at one side of the feed hopper 32. The main shaft 4 is vertically disposed inside the top frame 3 and the bottom frame 2 at the center. The top end of the main shaft 4 is supported in a locating block 35. The locating block 35 holds a spider bearing 36', a bearing block 36 and a shaft sleeve 37. A mantle core 40 is mounted around the main shaft 4 on the middle. A mantle 41 is mounted on the tapered wall of the mantle core 40. A check nut 401 is disposed above the mantle 41. The eccentric 5 is mounted around the lower part of the main shaft 4, having an outward coupling portion 51 at the bottom side thereof supported on a hydraulic cylinder 6. A big bevel gear 52 is fixedly mounted on the outward coupling portion 51 of the eccentric 5, and meshed with the pinion gear 22 on the counter shaft 21. The hydraulic cylinder 6 is provided at the bottom of the bottom frame 2, having a top opening through which the main shaft 4 is inserted into the hydraulic cylinder 6, and an outward top flange 60 around its top opening. The outward top flange 60 is mounted with a copper plate 601 for supporting the eccentric 5. A piston 61 is reciprocated in the hydraulic cylinder 6. The piston 61 is mounted with a first thrust board 62, and a second thrust board 63 above the first thrust board 62. The main shaft 4 has a bottom end mounted with a thrust board 42 supported on the second thrust board 63. The bottom end of the hydraulic cylinder 6 is connected to a hydraulic fluid pump (not shown) through a pipe 64. When the eccentric 5 is rotated during the operation of the counter shaft 21, the main shaft 4 is driven to rotate by the eccentric 5 and the inner bushing 54 in the eccentric 5. By means of reciprocating the piston 61, the main shaft 4 is moved vertically in the inner bushing 54 to adjust the crushing gap between the mantle 41 and the concave 31 without stopping the machine. As indicated above and shown in FIG. 2, the main shaft 4 is mounted inside the top frame 2 and the bottom frame 3 at the center. The top end of the main shaft 4 is supported on the locating block 35. The locating block 35 has mounted therein a fixed bearing block 36, a spider bearing 36' and a shaft sleeve 37 for supporting the top end of the main shaft 4 in place, permitting the main shaft 4 to be smoothly rotated by the eccentric 5. This arrangement still has drawbacks. Because the spider bearing 36' wear quickly with use, the gap between the spider bearing 36' and the main shaft 4 increases with the wearing condition of the spider bearing 36'. When the spider bearing 36' wears gradually, the rotary motion of the main shaft 4 becomes unstable, thereby causing a damage to the main shaft 4. Therefore, the spider bearing 36' must be frequently replaced before it starts to wear.

SUMMARY OF THE INVENTION

The present invention has been accomplished to provide a main shaft locating arrangement which eliminates the aforesaid problem. According to the present invention, the bearing block comprises a top block and a bottom block respectively covered on the spider bearing at top and bottom sides. The top block and bottom block each have an outward flange, and a plurality of locating holes and screw holes alternatively arranged around the spider bearing. The locating holes on the top block and the bottom block are respectively connected to respective locating holes on the locating block inside the top frame of the cone crusher. Adjustment screws are respectively threaded into the screw holes on the top block and the bottom block, and respectively stopped at the locating block at top and bottom sides for adjusting the gap between the top block and the bottom block subject to the wearing condition of the spider bearing.

DETAILED DESCRIPTION OF THE PREFERRED EMBODIMENT

Figure 1:
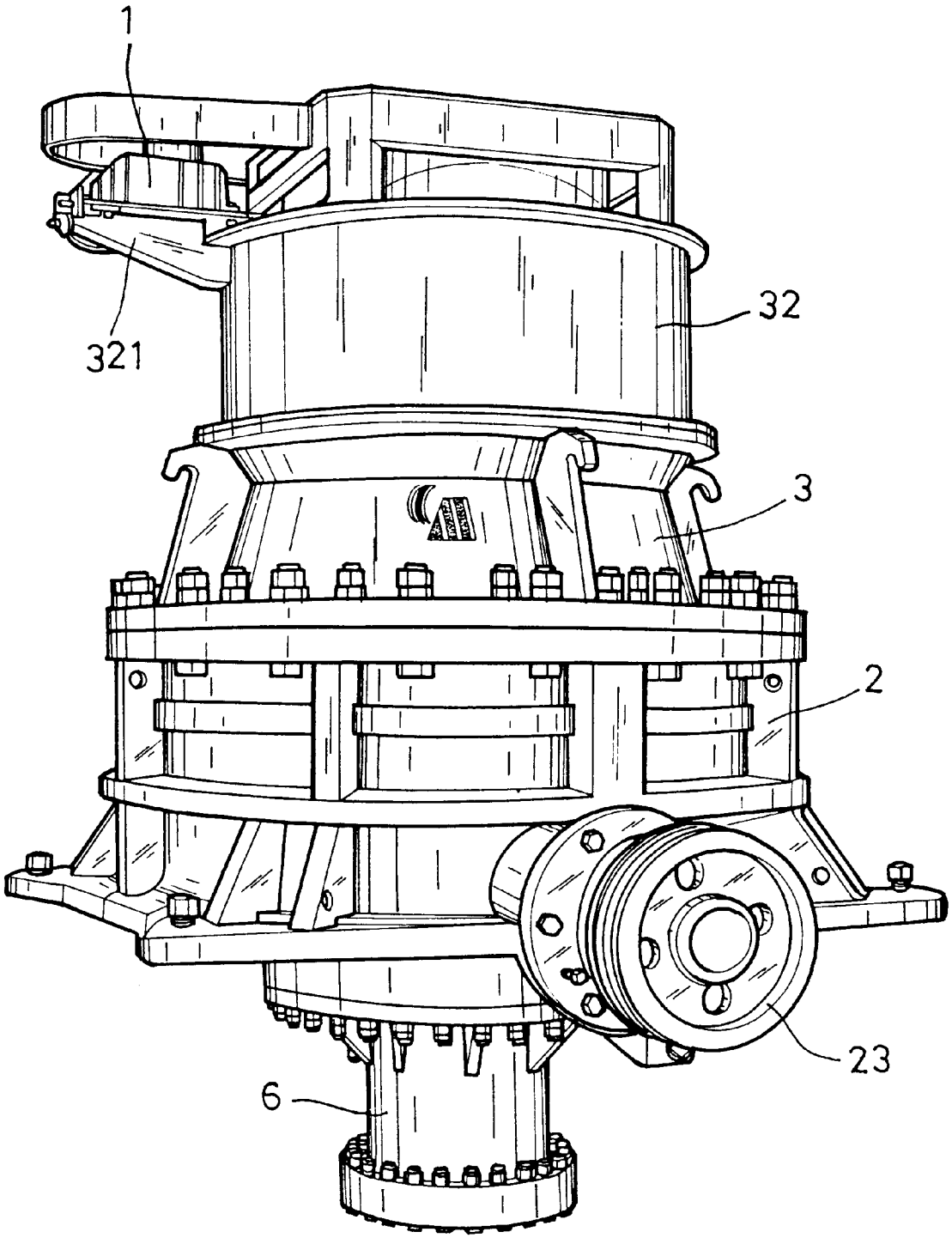
FIG. 1 is a perspective view of a regular hydraulic cone crusher.
Figure 2:
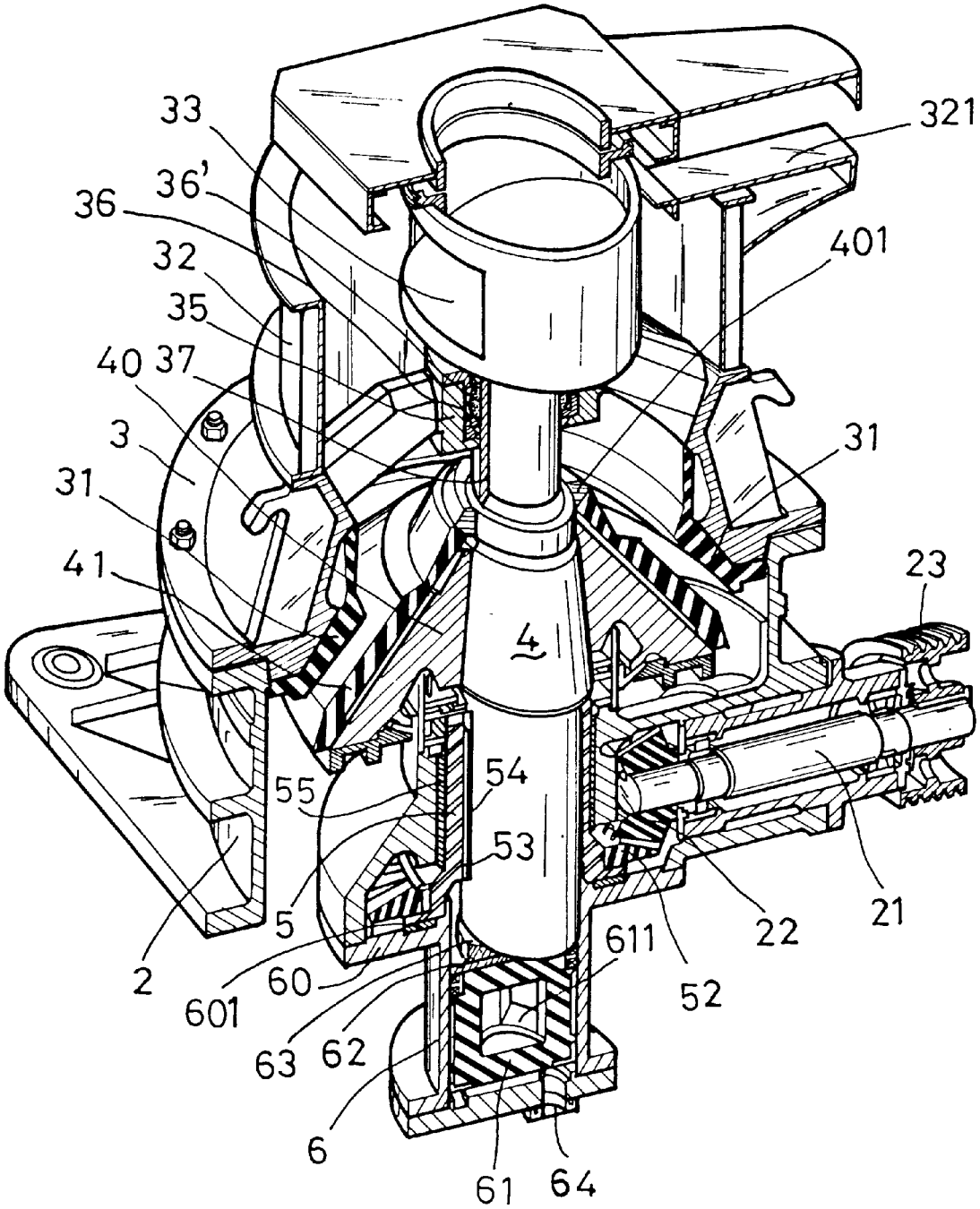
FIG. 2 is a cutaway of the hydraulic cone crusher shown in FIG. 1.
Figure 3:
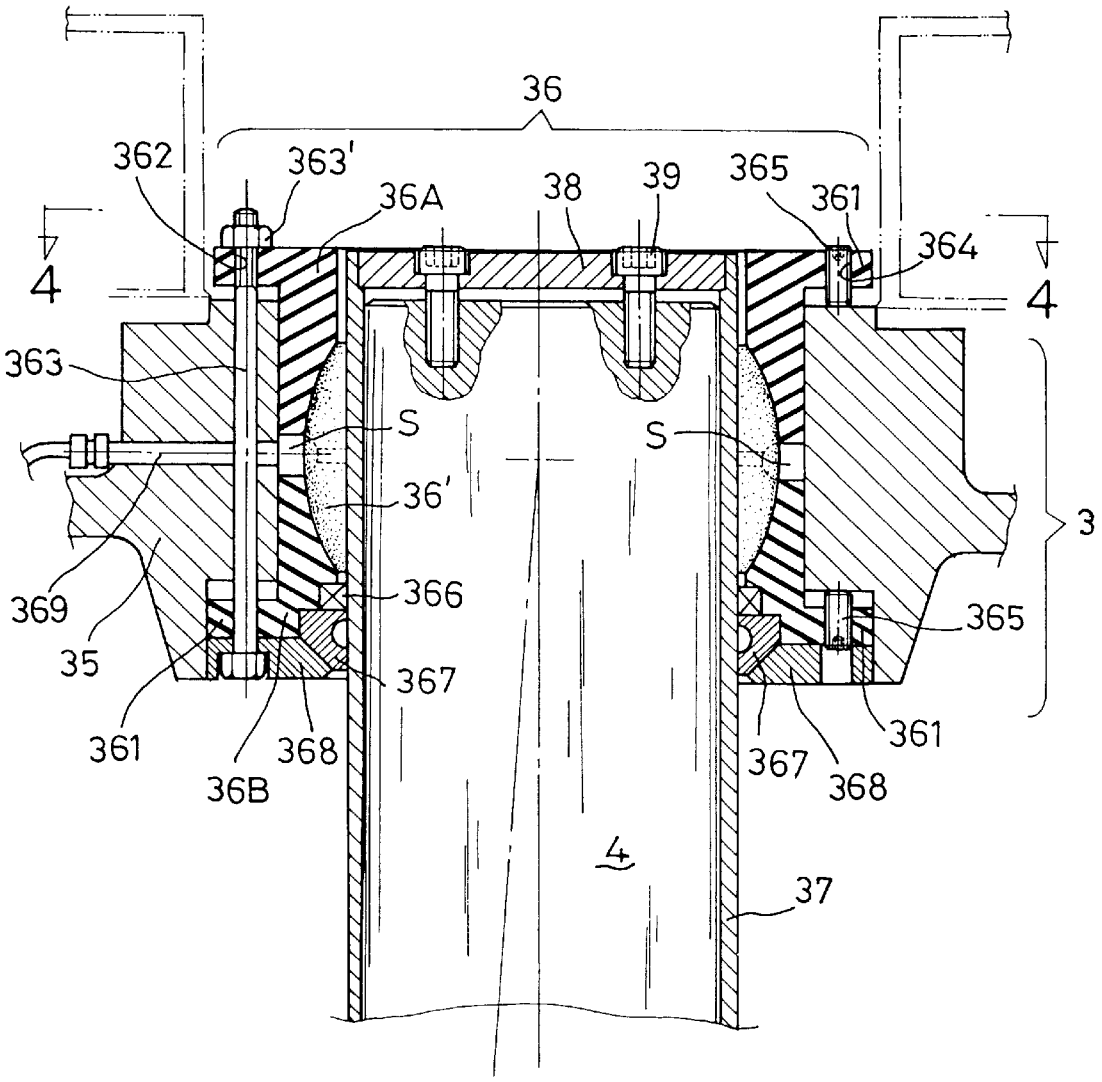
FIG. 3 is a sectional view of the present invention.
Figure 4:
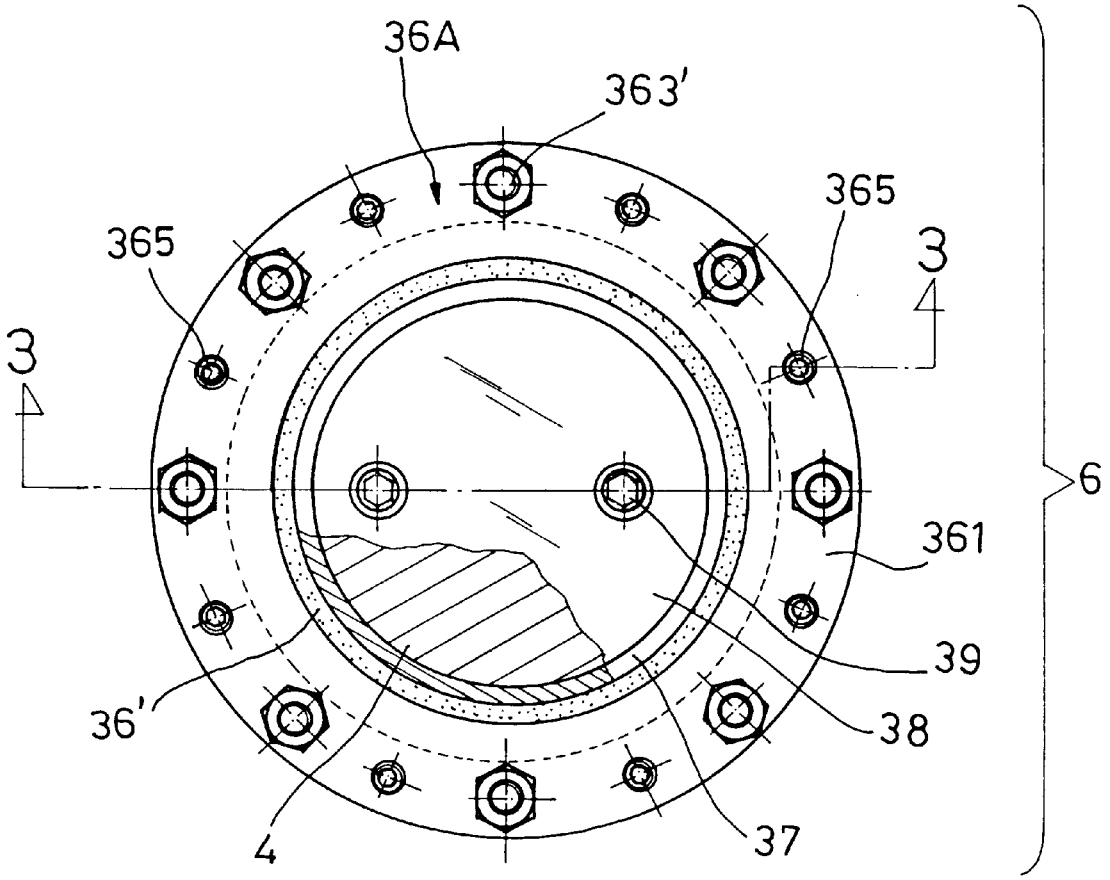
FIG. 4 is a sectional view taken along line 4—4 of FIG. 3.

Referring to FIGS. 3 and 4, the top end of the main shaft 4 is supported on the bearing block 36. The bearing block 36 is comprised of an upper block 36A and a bottom block 36B. The upper block 36A and the bottom block 36B are respectively covered on the spider bearing 36' at top and bottom sides around the main shaft 4. The upper block 36A and the bottom block 36B each have an outward flange 361 remote from each other, and a plurality of locating holes 362 and screw holes 364 alternatively arranged at the outward flange 361. The locating holes 362 on the outward flanges 361 of the blocks 36A;36B are connected to the locating block 35 on the top frame 3 of the cone crusher by screw bolts 363 and nuts 363'. Adjustment screws 365 are respectively threaded into the screw holes 364 on the outward flanges 361 of the blocks 36A;36B and respectively stopped at top and bottom sides of the locating block 35, permitting a gap S to be left between the upper block 36A and the bottom block 36B. When the spider bearing 36' starts to wear, the adjustment screws 365 are evenly adjusted to keep the spider bearing 36' in close contact with the main shaft 4. The bottom side of the bottom block 36B is mounted with an oil seal 366, a dust ring holder 368, and a dust ring 367. A lubricating pipe 369 is inserted into the gap S for applying a lubricating grease to the spider bearing 36'. Further, a shaft sleeve 37 is mounted around the main shaft 4, and secured thereto by an end plate 38 and screws 39.

The parts are installed in the top frame 3 in the order of bottom block 36B→ oil seal 366→ dust ring 367→ dust ring holder 368→ spider bearing 36'→ upper block 36A→ screw bolts 363→ adjustment screws 365. When installed, the top frame 3 is mounted on the main shaft 4 at the top, enabling the main shaft 4 to be rotated in the spider bearing 36'.

As indicated above, when the spider bearing 36' starts to wear, it is not necessary to replace the spider bearing 36'. By adjusting the adjustment screws 365 to reduce the gap between the upper block 36A and the bottom block 36B, the spider bearing 36' is maintained in close contact with the main shaft 4. Therefore, the aforesaid arrangement prolongs the service life of the spider bearing 36'.

What the invention claimed is:

1. A bearing block mounting arrangement comprising a bearing block mounted in a cone crusher to hold a spider bearing on a main shaft, said bearing block comprising an upper block and a bottom block respectively covered on top and bottom sides of said spider bearing, said upper block having an outward top flange and a plurality of locating holes and screw holes alternatively arranged around said spider bearing, said bottom block having an outward bottom flange and a plurality of locating holes and screw holes alternatively arranged around said spider bearing, the locating holes on the outward top flange of said upper block being respectively connected to the locating holes on the outward bottom flange of said bottom block and respective locating holes on a locating block inside said cone crusher by screw bolts and nuts, a plurality of adjustment screws respectively threaded into the screw holes on said upper block and said bottom block and stopped at top and bottom sides of said locating block for adjusting the gap between said upper block and said bottom block.

2. The bearing block mounting arrangement of claim 1, wherein said bottom block has a bottom side mounted with an oil seal, a dust ring holder, and a dust ring on said dust ring holder.

3. The bearing block mounting arrangement of claim 1 further comprising a lubricating pipe inserted into the gap between said upper block and said bottom block for applying a lubricating grease to said spider bearing.

* * * * *